United States Patent [19]

Pomfret

[11] 3,955,277

[45] May 11, 1976

[54] ADJUSTABLE RAZOR BLADE UNIT

[75] Inventor: Edward E. Pomfret, Newbury, England

[73] Assignee: The Gillette Company, Boston, Mass.

[22] Filed: Sept. 17, 1974

[21] Appl. No.: 506,762

[30] Foreign Application Priority Data

Sept. 20, 1973 United Kingdom ..... 44265/73

[52] U.S. Cl. ..... 30/47; 30/50

[51] Int. Cl.[2] ..... B26B 21/22

[58] Field of Search ..... 30/30, 31, 47, 50, 60, 30/60.5, 61, 63, 71, 320

[56] References Cited

UNITED STATES PATENTS

| | | | |
|---|---|---|---|
| 1,448,341 | 3/1923 | Graef | 30/31 |
| 2,204,827 | 6/1940 | Sheehan | 30/63 |
| 3,803,712 | 4/1974 | Spanel | 30/30 |
| 3,816,912 | 6/1974 | Glaberson | 30/63 X |

FOREIGN PATENTS OR APPLICATIONS

| | | | |
|---|---|---|---|
| 459,718 | 10/1950 | Italy | 30/71 |
| 601,057 | 12/1959 | Italy | 30/30 |

*Primary Examiner*—Al Lawrence Smith
*Assistant Examiner*—Gary L. Smith
*Attorney, Agent, or Firm*—Richard A. Wise; Oistein J. Bratlie; Scott R. Foster

[57] ABSTRACT

A razor blade unit having a cap portion, guard portion, and a blade member clamped therebetween, the unit further having coupling structure for detachably connecting the unit to a cooperating handle, and adjusting mechanism integral with the unit and operable independently of any cooperating handle for changing the relative positioning of the blade member and guard portion to vary the shaving geometry of the blade unit.

4 Claims, 4 Drawing Figures

8
24
48
50
22
10
62
16
12
60
14
6
46
56
26
40
44
54
52
4
18
70
40
2
70

50
8
22
62
24
16
48
10
12
6
60
14
46
26
4
44
54
52
18
70
40
2
70

ADJUSTABLE RAZOR BLADE UNIT

BACKGROUND OF THE INVENTION

1. Field of the Invention

This invention relates to safety razors and more particularly to blade units of the type arranged for detachable connection to a cooperating handle component, the blade unit including a blade member and a cooperating guard member.

2. Description of the Prior Art

It is frequently desirable to provide a construction in a safety razor which enables the user to adjust the shaving geometry to suit his individual preferences and/or shaving requirements. Significant components of that shaving geometry include "blade tangent angle", "exposure" and "span".

"Blade tangent angle" is defined as the angle between the bisector of the included angle of a cutting edge and a line from the cutting edge to the point of tangency of the skin engaging surface immediately forward of that cutting edge. For example, in a two bladed tandem acting system, the guard is the "skin engaging surface immediately forward" of the first acting cutting edge and the first cutting edge is the "skin engaging surface immediately forward" of the second cutting edge.

"Exposure" is defined as the distance from a cutting edge to a reference plane of a line connecting the points of tangency of the skin engaging surfaces immediately in front of and behind the cutting edge, the distance being measured perpendicularly to the reference plane or line.

The exposure is considered positive when the cutting edge is located on the outer or skin side of the reference plane and is considered negative when the cutting edge is further from the skin than that plane.

"Span" is defined as the distance between a cutting edge and the point of tangency of the skin engaging surface forward of the cutting edge.

Blade units of the type which include a blade and guard member as a unit adapted for connection to a separate handle member provide the advantages of a compact structure in which appropriate shaving geometry relationships are established and maintained throughout the useful life of the blade unit. It is desirable that the shaving geometry be selectively adjustable to suit particular users, however a number of problems arise in a blade unit construction of this type in which a shaving geometry adjustment is provided. For example, the adjustment must be easy to make and permit a wide range of shaving geometries, while not creating any potentially hazardous condition for the user; the incremental production cost of the adjustable feature, to the extent that it is incorporated in the replaceable blade unit, must be minimal in order to be economically competitive; the blade unit must be compact; and the adjustable feature must not unduly complicate the blade unit structure. A number of proposals for adjustment of blade units of this type have been made, for example, as shown in German Offenlinguneschrift 2251633. The adjustment arrangements there shown employ auxiliary blade unit structure which is engaged by adjustment structure when the blade unit is attached to a handle component. Another example of proposals for adjustment of blade units of this type appears in U.S. application Ser. No. 432,842, filed Jan. 14, 1974 in the name of Chester F. Jacobson. The adjustment arrangements there shown employ pivoting means, permitting the guard or blade to be pivoted relative to the other.

SUMMARY OF THE INVENTION

It is an object of this invention to provide a novel and improved blade unit which enables adjustment of shaving geometry simply and reliably.

It is another object of this invention to provide a novel and improved blade unit structure which includes an integral shaving geometry adjustment mechanism.

A still further object of the invention is to provide novel and improved shaving geometry adjustment arrangements which are adaptable to high volume production techniques, both in the manufacturing of the components of the blade unit and the assembly of the components into a blade unit.

With the above and other objects in view, as will hereinafter appear, a feature of the present invention is the provision of a blade unit for detachable connection to a handle component and which includes a blade member and a permanently associated guard member. The blade member is adapted for movement relative to the guard and this movement is controlled by an adjustment mechanism integral with the blade unit. The shaving geometry range is thereby a function of the blade unit alone, independent of the nature of the handle component to which the unit is connected.

The above and other features of the invention, including various novel details of construction and combinations of parts, will now be more particularly described with reference to the accompanying drawings and pointed out in the claims. It will be understood that the particular devices embodying the invention are shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown the illustrative embodiments of the invention from which its novel features and advantages will be apparent.

DESCRIPTION OF THE PREFERRED EMBODIMENTS

Figure 1:
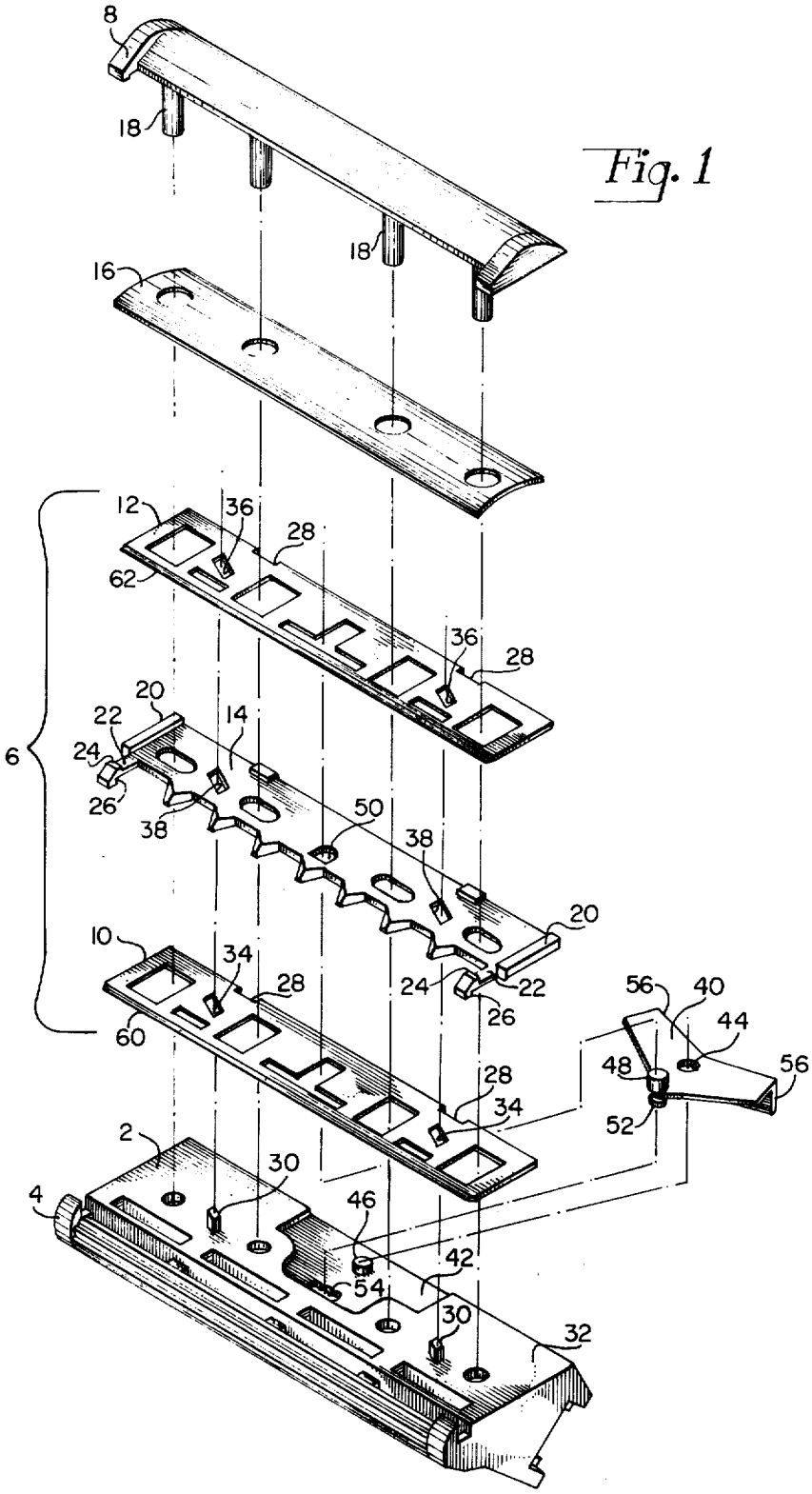
FIG. 1 is a perspective exploded view showing one form of shaving unit illustrative of an embodiment of the invention.

Referring to FIG. 1, it will be seen that the preferred embodiment includes a platform member 2 including a guard portion 4, a blade means 6, and a cap member 8. In the embodiment shown, the blade means includes a first blade 10, a second blade 12, and a spacer member 14 therebetween. A bowed plate spring 16 is disposed between the second blade 12 and the cap member 8. The platform member 2 and the cap member 8 may each be formed as moldings of synthetic plastic material, the cap 8 having integral pins 18 extending downwardly through corresponding apertures in the other components and being upset at their lower ends, as by application of pressure and/or heat, to secure the assembly and make the cap 8 fast with the platform 2, the blade means 6 and spring 16 being disposed therebetween.

The spacer member 14, which is preferably of metal, is provided at its opposite ends with thickened portions forming end stops 20 projecting from the upper and lower surfaces of the spacer member 14. Forwardly projecting arms 22 at opposite ends of the spacer member have thickened ends forming front stops 24, 26, the stops 20, 24, and 26 serving to locate the respective upper and lower blades, whose rear edges are notched at 28 to engage rear stops 29 disposed on the spacer member 14.

The plate spring 16, disposed between the cap member 8 and the second blade 12, provides frictional restraint against movement of the blade means 6 which is, however, movable as a unit relative to the cap and platform members, in the plane of the blade means, both longitudinally and transversely of the shaving unit.

Still referring to FIG. 1, it will be seen that cam projections 30 extend upwardly from the generally planar upper surface 32 of the platform member 2 and have edges which are inclined at an angle to the length of the guard portion 4. The first and second blade members and the spacer member have corresponsing cam slots 34, 36, 38, respectively, to receive the projections 30, the slots 34, 36 and 38 being longer than the projections 30 to permit movement of the blade means 6 relative to the platform 2 longitudinally of the slots and projections.

The shaving unit is further provided with an operating lever 40 received in a recess 42 in the platform 2 and having a hole 44 which receives a pivot pin 46 integral with the platform member. At its forward end, the lever 40 has an upwardly extending projection 48 for engagement in a hole 50 in the spacer member 14 and a downwardly extending projection 52 for disposal in a recess 54 in the platform member, the recess 54 being of generally arcuate form, centered on the pivot pin 46 and having a central portion and two side portions, the central and side portions each being of part annular shape and cooperating with the projection 52 to provide a central indexing means, identifying three separate angular positions of the lever 40. The outer or rear portion of the lever 40 is shaped to provide two divergent arms 56 which project from the rear edge of the shaving unit.

In operation, angular movement of the lever 40 by an operator from one index position to another will, through interaction of the projection 48 with the sides of the hole 50 in the spacer 14, urge the spacer, and thereby the entire blade means 6 longitudinally of the platform. However, interaction between the cam projections 30 and the cam slots 34, 36 and 38 will constrain the blade means to move transversely of the platform, as well as longitudinally, thus moving cutting edges 60, 62 of the first and second blades 10, 12 transversely of the platform toward or away from the guard member, whereby to vary the blade exposure. In a particular embodiment, the exposure may be varied from 0.0064 inch positive (FIG. 2) to 0.0008 inch negative (FIG. 3) for the first blade 10, with an intermediate setting of 0.0015 inch positive. Such variation in exposure is necessarily accompanied by corresponding variation in blade tangent angle and span of the first blade.

Figure 2:
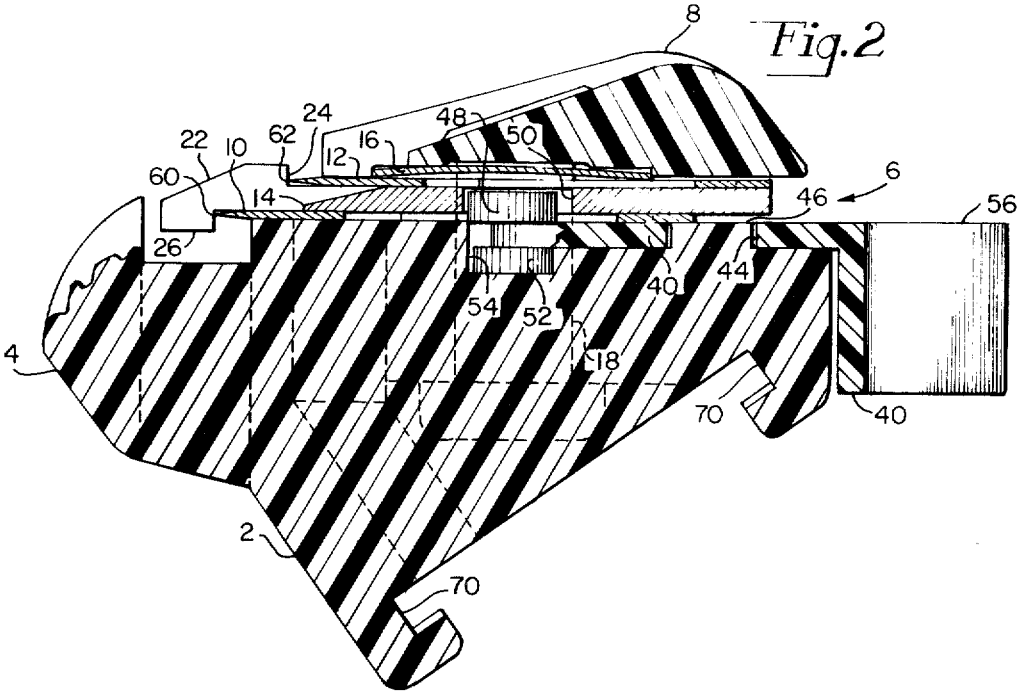
FIG. 2 is a sectional view through the center of the shaving unit of FIG. 1 and showing one extreme position of the blade means relative to the guard.
Figure 3:
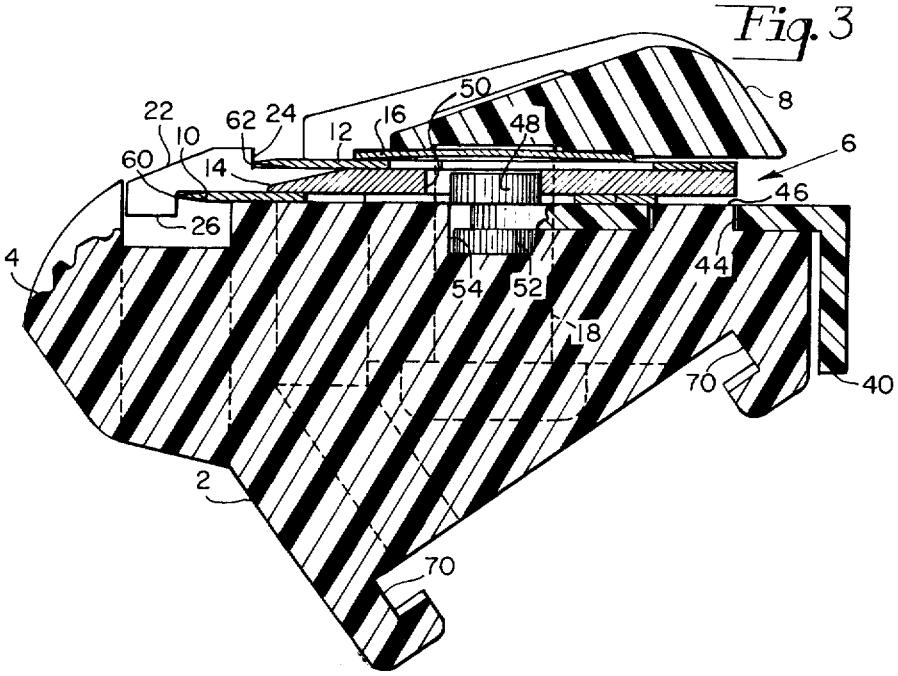
FIG. 3 is a sectional view, similar to FIG. 2, but showing the blade means in the alternative extreme position.

Referring to FIG. 2, it will be seen that the blade means is disposed in its forward-most position, while in FIG. 3, there is shown the blade means disposed in its most rearwardly position.

The operating lever 40 provides a convenient means of adjusting the position of the blade means relative to the guard portion. In a typical shaving unit the platform is provided with coupling structure in the form of longitudinally extending grooves 70 at the underside of the platform to engage frictionally over rails provided on a handle. In making an adjustment to shaving geometry, operating pressure is applied to the lever 40 in a direction transverse to the shaving unit, thereby eliminating the risk of the user inadvertently disengaging the unit from the handle. The lever 40 also facilitates single-handed operation of the adjustment means, and still further, offers the user a mechanical advantage in overcoming frictional resistance to movement of the blade means relative to the platform.

Figure 4:
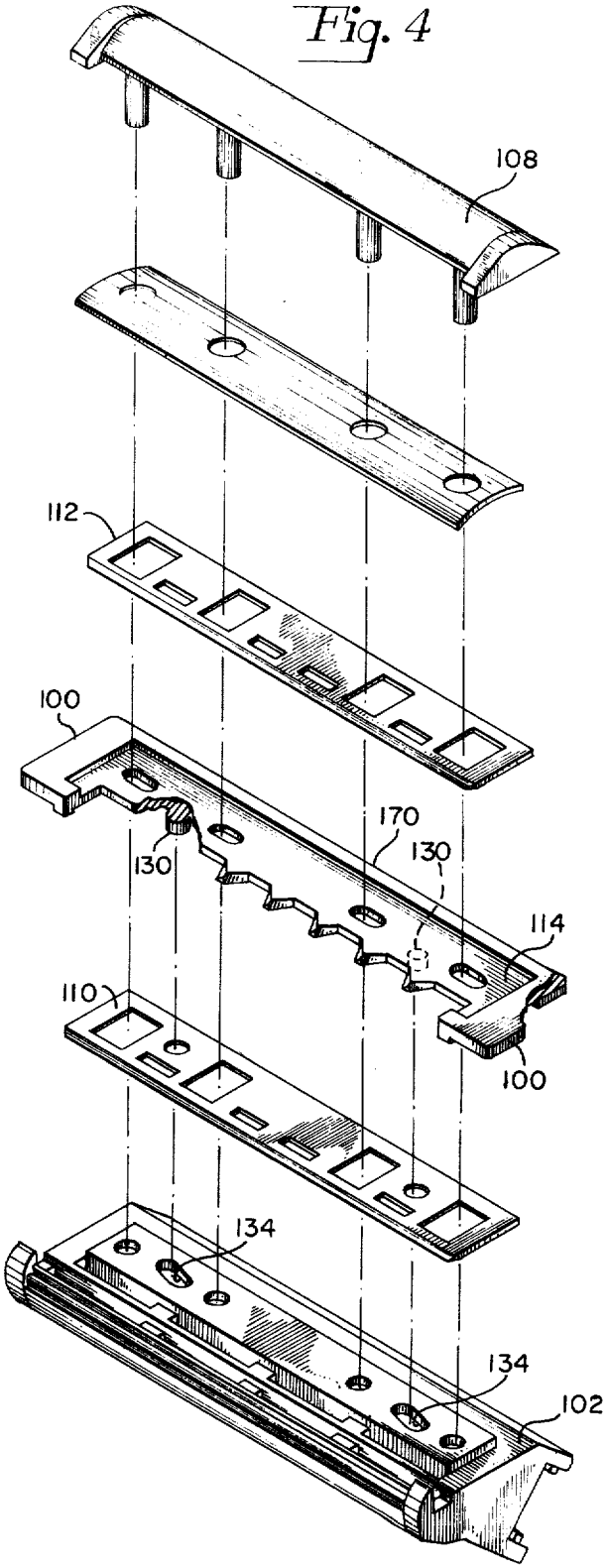
FIG. 4 is a perspective exploded view of another form of shaving unit illustrative of an alternative embodiment of the invention.

An alternative embodiment, shown in FIG. 4, is generally similar to that described above, the major difference being that in the case of the alternative embodiment, adjustment is affected by the user gripping end portions 100 of a spacer 114 directly, and sliding the spacer longitudinally, relative to a platform 102, a cam means 130 acting, as before, to constrain the spacer 114 and blades 110, 112 to partake of a concomitant transverse movement.

In the illustrative alternative embodiment the cam means 130 extend downwardly from the underside of the spacer 114 into elongated cam slots 134 in the platform 102.

The spacer 114 of the alternative embodiment has an upstanding peripheral wall 170 for locating the blades 110, 112, the end portions 110 being extended longitudinally to project outwardly between the platform 102 and a cap 108 so that the end portions 100 of the spacer can be comfortably gripped between the thumb and the forefinger of a user.

It is to be understood that the present invention is by no means limited to the particular construction herein disclosed and/or shown in the drawings, but also comprises any modifications or equivalents within the scope of the disclosure.

Having thus described my invention what I claim as new and desire to secure by Letters Patent of the United States is:

1. A razor blade unit comprising a platform member having a guard portion and coupling structure for detachably connecting said platform member to a cooperating handle component, a cap member permanently fastened to said platform member, a blade means permanently disposed between said platform member and said cap member, said blade means comprising a spacer member and first and second blade members respectively adjacent first and second sides of said spacer member, said spacer member having means integral therewith for retaining said first and second blade members, said blade means being slidably movable longitudinally of said blade unit, cam means disposed on said blade unit for displacing said blade means transversely of said blade unit in response to such longitudinal movement, and lever means disposed on said blade unit, said spacer member having means for receiving a portion of said lever means, said lever means being operable to effect said longitudinal movement of said spacer member and through said first and second blade retaining means longitudinal movement of said first and second blade members responsive to pressure applied to said lever means in a direction generally transverse to said blade unit, thereby to cause movement of said blade means relative to said guard portion to vary the distance between a cutting edge of said blade means and said guard portion.

2. The invention according to claim 1 in which the unit includes indexing means for locating the blade means relative to the guard portion in any one of a finite number of predetermined positions along the path of movement.

3. The invention according to claim 1 in which the cutting edges of said first and second blade members are in parallel spaced relationship and operate in tandem on the skin of a user.

4. The invention according to claim 1 in which the blade member is movable in its own plane.

* * * * *